US006463630B1

(12) United States Patent
Howie, Jr.

(10) Patent No.: US 6,463,630 B1
(45) Date of Patent: Oct. 15, 2002

(54) COMPOSITE KNOB HAVING A PULLOUT AND TORQUE RESISTANT INSERT WITH A THREADED SOCKET

(75) Inventor: Robert K. Howie, Jr., Decatur, IL (US)

(73) Assignee: The Grigoleit Company, Decatur, IL (US)

( * ) Notice: Subject to any disclaimer, the term of this patent is extended or adjusted under 35 U.S.C. 154(b) by 0 days.

(21) Appl. No.: 09/511,224

(22) Filed: Feb. 23, 2000

(51) Int. Cl.[7] ..... G05G 1/10

(52) U.S. Cl. ..... 16/441; 16/DIG. 41; 74/553; 74/548

(58) Field of Search ..... 16/441, 417, 414, 16/433, DIG. 41; 74/553, 548; 403/372, 315, 316, 317, 274, 282, 192, 194, 200

(56) References Cited

U.S. PATENT DOCUMENTS 1,791,798 A * 2/1931 Coen ..... 74/553
3,430,994 A * 3/1969 Keeler, II ..... 403/372
3,572,162 A * 3/1971 Gresham et al. ..... 16/441
4,000,539 A * 1/1977 Neyer ..... 16/441
4,766,642 A * 8/1988 Gaffney et al. ..... 16/441
4,961,443 A * 10/1990 Buccicone et al. ..... 74/548
5,741,003 A * 4/1998 Segien, Jr. ..... 16/441
5,836,214 A * 11/1998 Marquis ..... 16/DIG. 41
6,242,064 B1 * 6/2001 Howie, Jr. ..... 16/441

* cited by examiner

*Primary Examiner*—Anthony Knight
*Assistant Examiner*—Doug Hutton
(74) *Attorney, Agent, or Firm*—Cook, Alex, McFarron, Manzo, Cummings & Mehler, Ltd.

(57) ABSTRACT

A composite knob having a pullout and torque resistant insert with a shaft receiving threaded socket. One embodiment of the composite knob includes a disc shaped plastic body having a central hub. A plastic insert is embedded in the central hub. A threaded socket is formed in the plastic insert. A number of radially extending ribs are formed integrally with and extend radially from the plastic insert. These ribs are triangular shaped with inclined forwardly and rearwardly facing surfaces which are embedded in the hub of the disc shaped plastic body. A decorative cover may be positioned over the front face of the disc shaped body and secured to the body with a soft flexible plastic outer covering. In another embodiment, the plastic body includes a blade shaped handle with an insert that fits within the handle. The insert is formed with laterally extending portions which are entrapped by flanges formed integrally with the plastic body. The insert has at least one slot which receives plastic of the plastic body to resist torque applied to the composite knob.

7 Claims, 3 Drawing Sheets

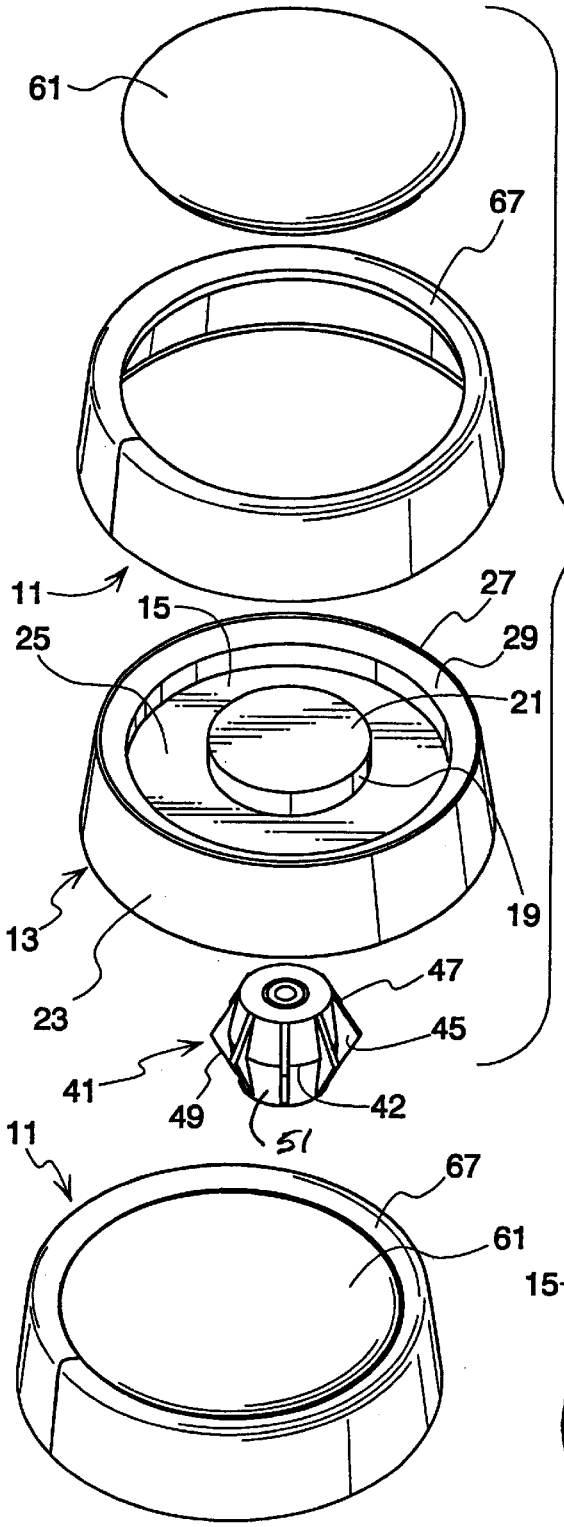
Fig. 1
Fig. 2
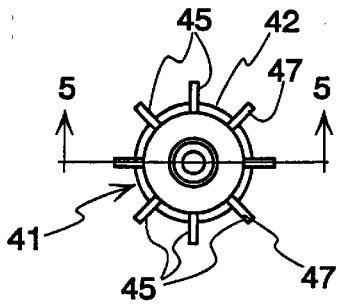
Fig. 4
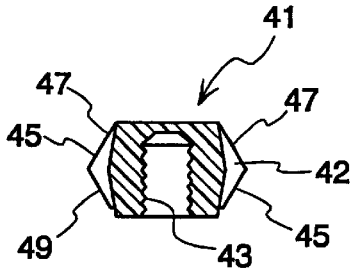
Fig. 5
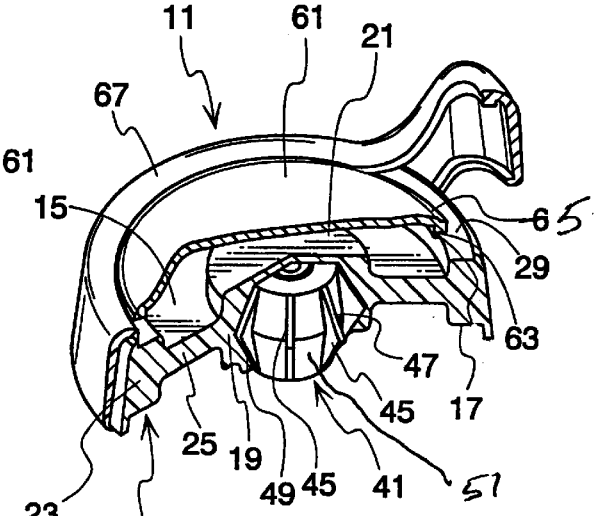
Fig. 3

COMPOSITE KNOB HAVING A PULLOUT AND TORQUE RESISTANT INSERT WITH A THREADED SOCKET

BACKGROUND AND SUMMARY OF THE INVENTION

This invention is directed to a composite plastic knob which is attachable to a threaded shaft. Conventional plastic knobs used in the appliance industry, such as washer timer knobs, are frequently attached to a threaded shaft, which shaft is usually made of metal. Because such shafts are both moved longitudinally, that is, in and out, and rotated during normal operation of an appliance, the knobs are subjected to relatively severe longitudinal forces and torques. The longitudinal forces are caused by the inwardly pushing and outwardly pulling of the knob and its shaft. The torque is due to the turning of the knob and its shaft. To stand up to these relatively severe operating conditions, it has been conventional to equip such plastic knobs with molded in threads. However, the molded in threads often crack with the cracks propagating to such an extent that parts of the knob become separated from the knob body rendering the knob non-functional. Threaded metal inserts can be molded into or otherwise be assembled as part of a molded knob, however, such metal inserts are inordinately expensive. Threaded molded plastic inserts are more economical to manufacture than metal inserts but they are also prone to crack propagating problems as are molded in threads.

Accordingly, an object of this invention is a molded plastic threaded insert which limits crack propagation by providing an interface between an insert and a knob which eliminates the homogeneity of material that occurs when threads are molded into the knob.

Another object of this invention is a composite plastic knob having a threaded insert that resists pullout or push through even if the insert fractures during use.

Another object of this invention is a composite plastic knob in which the insert is formed of a plastic and is equipped with ribs which become embedded in the plastic of the knob body to resist pullout, push through or twisting of the insert relative to the knob body.

Yet another object of this invention is an insert for a composite knob which insert has triangularly shaped ribs formed with forward and rearward facing surfaces inclined to the longitudinal axis of insert so as to provide improved gripping with the plastic of the knob body.

Still another object of this invention is a composite plastic knob having a body molded to substantially encapsulate a threaded insert, the threaded insert having a knob body engaging surface of ribs and slots, the volume and number of the ribs and slots being adjustable to vary the mass of the molded knob body to avoid sink marks on the knob face while preventing push through of the insert.

Other objects of this invention will be found in the following specification, claims and drawings.

BRIEF DESCRIPTION OF THE DRAWINGS

The invention is illustrated more or less diagrammatically in the following drawings wherein:

FIG. 1 is an orthographic view of one embodiment of the composite knob of this invention;

FIG. 2 is an exploded view of the knob of FIG. 1;

FIG. 3 is a cross sectional view of the knob of FIG. 1 with a portion of an outer plastic covering of the knob partially pulled away from the knob for clarity of illustration;

FIG. 4 is a top plan view of the knob insert of this embodiment of the invention;

FIG. 5 is a cross sectional view taken along line 5—5 of FIG. 4;

DESCRIPTION OF THE PREFERRED EMBODIMENTS

Figure 6:
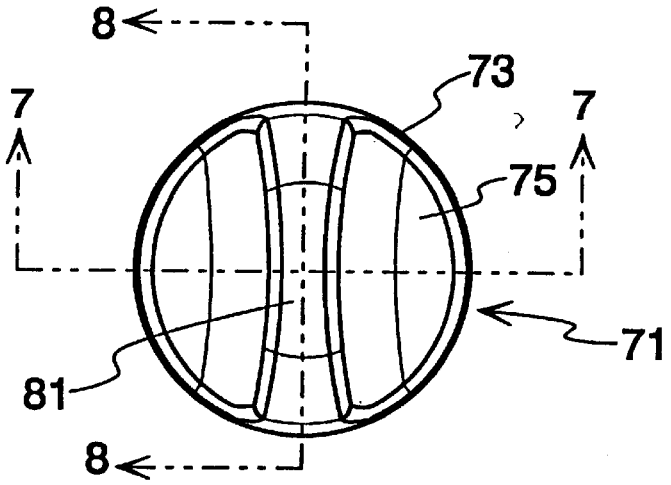
FIG. 6 is a top plan view of another embodiment of the knob of this invention.

FIG. 1 of the drawings shows a composite knob 11, molded in accordance with the teachings of one embodiment of this invention. As most clearly seen in the exploded view of FIG. 2, the knob includes a disc shaped plastic body 13, having a front face 15 and a rear face 17 shown in FIG. 3. Polypropylene is the preferred plastic for the body 13 of the knob of this embodiment of the invention but it should be understood and appreciated that other plastics that are known to those of ordinary skill in the art to have suitable characteristics may also be used. It should also be understood that other types and shapes of knobs may incorporate the novel aspects of this invention, one of which is described in detail in the second embodiment of this invention.

For purposes of orientation, the front face of the composite knob 11 is considered the surface visible to a user while the rear face is the surface that is contiguous to or faces an appliance on which the knob is installed. The disc shaped plastic body 13 includes a hub 19 having a front surface 21. A peripheral wall 23 is molded integrally with and is connected to the hub by an annular web 25, which web is thinner than the peripheral wall 23. A lip 27 extends around the periphery of the wall 23 of the hub and defines an annular front surface 29 for the peripheral wall 23.

A plastic insert 41, which is somewhat barrel shaped, having an enlarged equatorial area line 42, is embedded in the hub 19 of the disc shaped body 13. Acetal is the preferred plastic for the insert, but as previously described, other suitable plastics may be used. Preferably, the plastic insert is molded first and positioned in tooling in a second step of a two step molding process. The plastic forming the disc shaped body 13 is injected into the tooling to surround and embed the plastic insert. The plastic insert 41 includes a threaded socket 43, which opens from the rear face 17 of the knob body 13. Formed integrally with the plastic insert are a plurality of radially outwardly extending ribs 45 which are triangularly shaped. In this example, eight ribs are provided, but it should be appreciated that more or fewer ribs may be provided depending on the size of the insert and the shape and size of the particular knob to which this invention applies. Each rib 45 has a front facing inclined surface 47 and a rear facing inclined surface 49 which surfaces intersect at the bulging equator 42 of the insert. These surfaces engage and are embedded in the plastic of the hub 19 of the disc shaped body 13 to resist forward and rearward push through and pullout. In addition, these ribs and their surfaces secure the insert against twisting in the hub due to the application of torque to the insert when the knob turns its shaft. Other shapes of ribs may be utilized to accomplish the same purpose. The volume of and the number of the ribs can be varied to vary the mass of the disk shaped body 13, specifically the hub 19, to provide a sufficient mass to resist push through of the plastic insert 41, while minimizing the mass so as to prevent the type of shrinking of the front surface 21 of the hub 19 which is usually called a "sink mark". It should be understood that a slot 51 is formed between each pair of ribs. The volume of a slot, such as slot 51, determines the amount of plastic added to the mass of the body 13 while the volume of a rib 45 decreases the mass of the body 13. Thus, by varying the number of and the dimensions of the ribs in relation to the number of and dimensions of the slots formed in the insert, the mass of the body 13 may be varied.

This embodiment of the invention includes a decorative cover 61, which may be metal or plastic, is formed with a downwardly extending flange 63, which is most clearly shown in FIG. 3 of the drawings, and which rests on and engages the ring shaped front surface 29 of the peripheral wall 23 of the disc shaped body 13. The decorative cover 61 extends over the front surface 21 of the hub 19 of the body 13 as is shown most clearly in FIG. 3 of the drawings. The decorative cover also has front facing ledge 65 as can be seen in FIG. 3 of the drawings to receive a soft flexible plastic outer covering 67 which provides a soft feel to the knob and also secures the decorative cover 61 in position on the plastic body 13.

While the invention is shown embodied in an appliance timer knob having a decorative cover and a soft plastic wrap-around which secures the cover to the knob, it should be understood and appreciated that the novel aspects of the invention may be incorporated in other types of knobs in which it is necessary or desirable to prevent push through, pull out or twisting of the shaft engaging insert.

Figure 7:
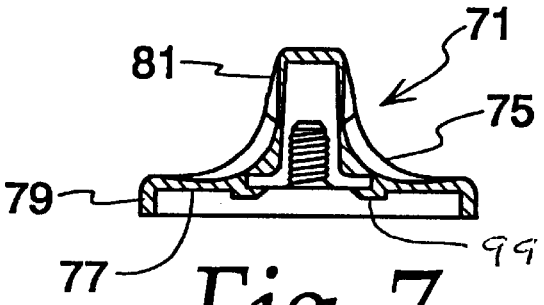
FIG. 7 is a cross sectional view taken along line 7—7 of FIG. 6.
Figure 8:
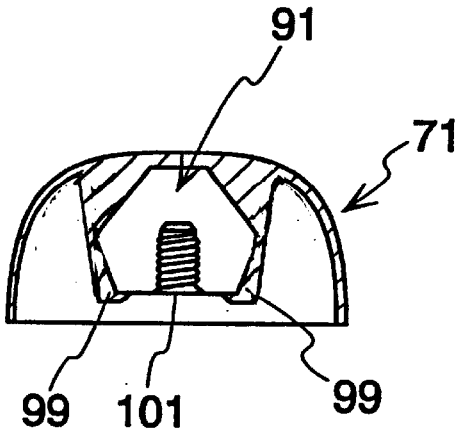
FIG. 8 is a cross-sectional view taken along line 8—8 of FIG. 6.
Figure 9:
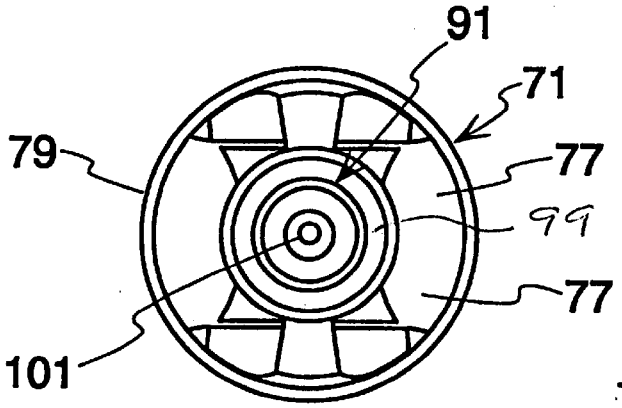
FIG. 9 is a bottom plan view of the knob of FIG. 6.
Figure 10:
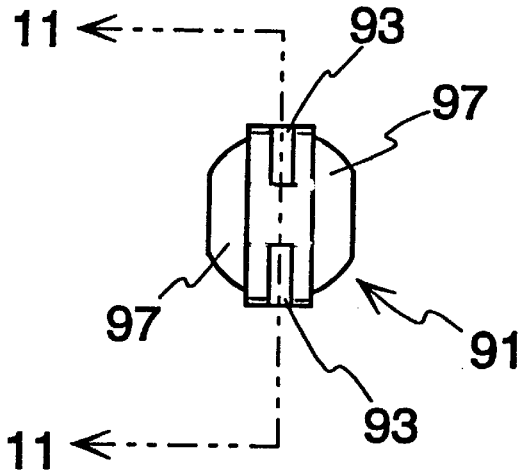
FIG. 10 is a top plan view of the knob insert of this embodiment of the invention.
Figure 12:
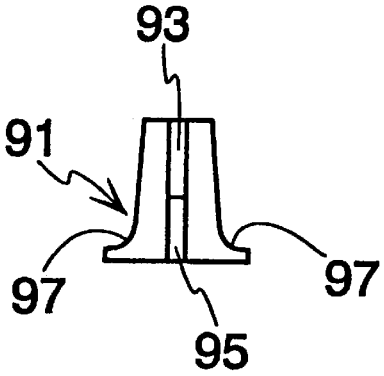
FIG. 12 is an end elevational view of the insert of FIG. 10.
Figure 11:
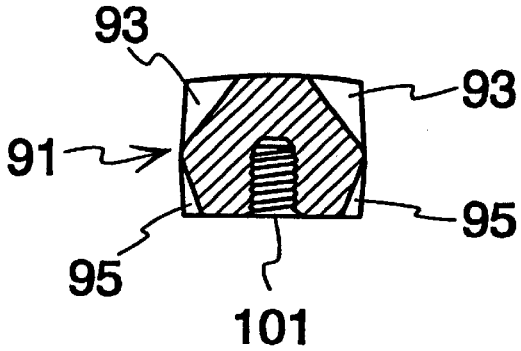
FIG. 11 is a cross sectional view taken along line 11—11 of FIG. 10.
Figure 13:
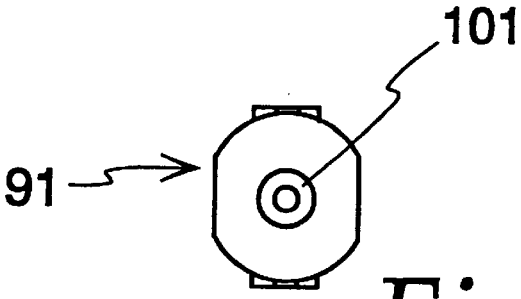
FIG. 13 is a bottom plan view of the insert of FIG. 10.

Another type of knob embodying the novel aspects of this invention is shown in the second embodiment of the invention in FIGS. 6 to 13 of the drawings which knob is commercially referred to as a blade handle knob 71. The knob 71 includes a plastic body 73 having a front face 75 and a rear face 77. A peripheral skirt 79 extends rearwardly of the rear face of the knob and a blade shaped handle 81 is formed as a portion of the front face 75 of the knob.

An insert 91 is molded first and positioned in tooling in the second step of a two step molding process. The plastic forming the body 73 is injected into the tooling to surround and embed the plastic insert 91. The plastic insert is somewhat hexagonal in vertical cross section as shown most clearly in FIGS. 8 and 11 of the drawings. Triangularly shaped slots 93 formed in the insert 91 open forwardly of the insert while smaller slots 95 also formed in the insert open rearwardly thereof. At its base, the plastic insert flairs out on opposite sides to form flanges 97 as can be best viewed in FIGS. 10 and 11 of the drawings. The flanges 97 are engaged on their undersides by an underturned flange 99 which is molded integrally with the plastic body 73 with the flange 99 locking the insert 91 into the plastic body 73. A threaded socket 101 is formed in the insert 91 so as to be accessible from the rear face 77 of the knob 71. Polypropylene is the preferred plastic for the body 73 of this embodiment of the invention but other plastics that are known to those skilled in the art to have suitable characteristics may also be used. Acetal is the preferred plastic for the insert 91, but as previously described, other suitable plastics may also be used.

The dimensions, and therefore the volume of the slots 93 and 95, may be varied to vary the mass of the plastic body 73 which substantially encapsulates the insert 91. Slots are the mirror images of ribs and in a sense the use of ribs and slots are interchangeable for the purpose of interlocking the insert and the body of the knob to resist torque. Thus, the relationship of the dimensions, effectively the relationship of the volumes of ribs to the volumes of the slots, can be varied to resist both torque and push through and to balance the mass of the overmolded plastic to mask the undesirable effects of shrinkage. Accordingly, both ribs and slots act as interlocking members for securing the insert to the knob body.

What is claimed is:

1. A composite knob having a pullout resistant insert with a socket, said composite knob including:

a plastic body, a barrel shaped plastic insert having an outer surface embedded in said plastic body, a socket formed in said plastic insert, and at least one interlocking rib formed on said plastic insert, said rib having inclined forwardly and rearwardly facing surfaces engaging said plastic body with said surfaces converging at the equator of said plastic insert.

2. The composite knob of claim 1, in which said plastic body includes a peripheral skirt and a blade type handle projecting from peripheral skirt with said plastic insert embedded in said blade type handle.

3. The composite knob of claim 2, in which said plastic body includes a blade portion and said plastic insert extends into said blade portion.

4. The composite knob of claim 1, in which said plastic insert has laterally extending portions and flanges of said plastic body engage said laterally extending portions to secure said insert to said plastic body.

5. The composite knob of claim 1, in which said socket formed in said plastic insert is threaded.

6. The composite knob of claim 1, in which said rib is triangularly shaped.

7. The composite knob of claim 1, in which said plastic body is disc shaped and includes a peripheral wall connected to a central hub by an annular web with said peripheral wall having a greater thickness than said annular web.

* * * * *